US005273079A

United States Patent [19]

Beyaert et al.

[11] Patent Number: 5,273,079

[45] Date of Patent: Dec. 28, 1993

[54] DRIVING WEAVING FRAMES FOR DIFFERENT TOP AND BOTTOM WARP TENSIONS AT BEAT UP

[75] Inventors: Daniel Beyaert, Wijschate-Heuvelland; Ignace Meyns, Reninge; Henry Shaw, Woesten-Vleteren, all of Belgium

[73] Assignee: Picanol N.V., naamloze vennootschap, Belgium

[21] Appl. No.: 948,323

[22] Filed: Sep. 22, 1992

[30] Foreign Application Priority Data

Sep. 23, 1991 [BE] Belgium ..... 09100883

[51] Int. Cl.[5] ..... D03C 5/00

[52] U.S. Cl. ..... 139/55.1; 139/57; 139/79

[58] Field of Search ..... 139/55.1, 57, 79, 114, 139/115, 1 R, 80, 81

[56] References Cited

U.S. PATENT DOCUMENTS 4,337,801 7/1982 Suzuki et al. .
5,082,029 1/1992 Dornier ..... 139/55.1 X

FOREIGN PATENT DOCUMENTS 2-127544 5/1990 Japan ..... 139/55.1
222222 7/1942 Switzerland .
1101482 7/1984 U.S.S.R. ..... 139/55.1

*Primary Examiner*—Andrew M. Falik
*Attorney, Agent, or Firm*—Bacon & Thomas

[57] ABSTRACT

A weaving method makes use of a set of weaving frames arranged such that, in each weaving cycle, some of the weaving frames are held in an identical extreme position, while all remaining weaving frames are moved in order to provide different tensions for the top and bottom warp threads at the moment of beating up. The shed is formed so that at the moment of crossing, as the weaving frames change position, the length of the course followed by the crossing warp threads is equal or almost equal to the length of the course followed by the warp threads held in the extreme position.

5 Claims, 4 Drawing Sheets

DRIVING WEAVING FRAMES FOR DIFFERENT TOP AND BOTTOM WARP TENSIONS AT BEAT UP

BACKGROUND OF THE INVENTION

This invention relates to a method for weaving, as well as to a device for driving weaving frames during the implementation of the aforementioned method.

The invention more especially relates to a method of the type whereby in each weaving cycle a number of weaving frames are held in a same extreme position, while all remaining weaving frames are moved.

Of the fabrics which are produced in this manner denim is the most common during the weaving of so-called blue jeans, for example blue warp threads are utilized and white weft threads are woven in. A so-called three/one weave is formed. This means that weaving is performed with one or more sets of four weaving frames, whereby with each shed change of each set, two weaving frames remain above the warp one weaving frame moves upward from below, and one weaving frame moves downward from above. With a completely open shed, therefore, three weaving frames are always in their highest position, while the fourth weaving frame is in its lowest position.

In order to obtain a good quality, or blue color in the case of blue jeans, it is known that at the moment of the beating up, the tension in the bottom warp threads should be greater than in the top warp threads.

It is also known that, in order to achieve a tension in the bottom warp threads is greater than the tension in the top warp threads, the guide for the start of the weaving shed should be brought up out of its normal position, this guide being either the back rest or a guide especially provided for this purpose, so that the top warp threads between the start and the end of the weaving shed have to travel a shorter course than the bottom warp threads.

The aforementioned technique of weaving, whereby the back rest or any other guide at the start of the weaving shed is placed upward out of its normal position, has however the disadvantage that when restarting the weaving machine after a machine stoppage starting stripes are sometimes formed, especially in the case where weaving is effected with closely beaten up weft threads and when the weaving machine has stood idle for relatively long.

SUMMARY OF THE INVENTION

The purpose of the present invention is therefore to provide a method and device which solves the aforementioned problem. Although this solution is especially applicable to air weaving machine, application of the invention to other weaving machines is not excluded.

For this purpose the invention relates to a method for weaving, and more especially to a method for weaving wherein use is made of a set of weaving frames of which in each weaving cycle are held in a same extreme position, while all remaining weaving frames are moved, and whereby different tensions are provided for the top and bottom warp threads at the moment of the beating up, and wherein a weaving shed is formed whereby at the moment of crossing when the weaving frames change position the length of the course followed by the crossing warp threads is equal or almost equal to the length of the course followed by the warp threads held in extreme position.

As a result at the moment that the crossing weaving frames are at the same height, the tension in the warp threads of the crossing weaving frames is equal to the tension in the warp threads of the weaving frames which remain in their extreme position. Because during a long-term interruption a weaving machine is generally stopped with the crossing weaving frames at equal height, the stretch and relaxation which develops in this position is equal for all warp threads, which is favorable for avoiding stripes in the fabrics when restarting the weaving machine.

For this purpose the vertex of the weaving shed is located in a suitable place, and the weaving frames are preferably moved so that they perform an asymmetric movement or cross each other at a position in their path of movement situated between the middle of the path and one extreme position, the one extreme position being opposite the extreme position in which the weaving frames are held still, i.e. when they perform no movement. The preferred embodiment offers the advantage that the vertex of the start of the weaving shed can lie relatively close to the normal position, so that with closely beaten up fabrics, or fabrics with relatively thick weft threads, or even fabrics with high weft density, the weft threads can easily be beaten up while avoiding stripes in the fabric when restarting the weaving machines. This embodiment also offers the advantage that in the extreme positions of the weaving frames, no extremely high tension occurs in the warp threads resulting in less warp thread breakage and permitting the average tension in the warp to be increased, thereby increasing the quality of the fabric.

In order to show better the characteristics of the present invention, some preferred embodiments are described hereafter, as examples without any restrictive character, with reference to the attached drawings, in which:

DETAILED DESCRIPTION OF THE PREFERRED EMBODIMENTS

Figure 1:
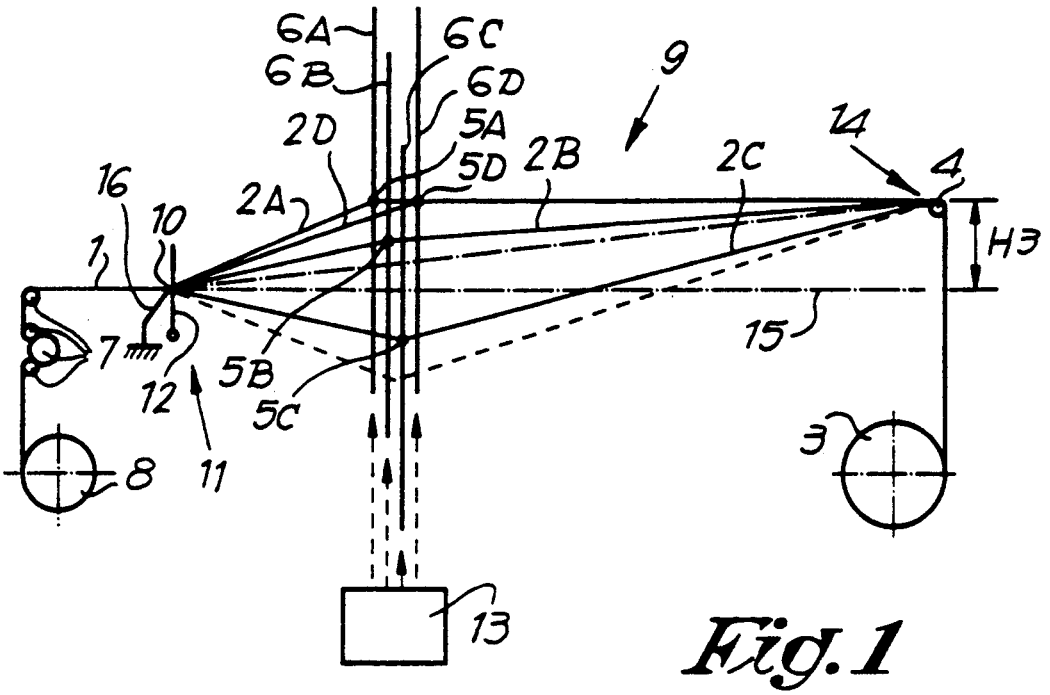
FIG. 1 shows a prior art weaving process with the weaving a denim fabric.

FIG. 1 schematically shows how a fabric 1, in this case denim, is manufactured. The warp pattern is repeated every four warp threads, which are indicated in FIG. 1 respectively by 2A, 2B, 2C and 2D.

The warp threads 2A–2D are wound in the usual manner from a warp beam 3, guided along the back rest 4 and passed through the thread eyes 5A–5D of the weaving frames 6A–6D. The fabric 1 is formed by weaving warp threads 2A–2D in with the weft threads and is carried via the necessary guides 7 toward the cloth roller 8. The weft threads are, as is known brought into the opened weaving shed 9 and beaten against the cloth line 10 by means of the batten 11 and the reed 12.

The weaving frames 6A–6D are moved up and down in known manner by means of a suitable device 13.

In the case that denim is woven, the weaving frames 6A–6D are moved so that only two weaving frames, in FIG. 1 the weaving frames 6B and 6C, perform a crossing movement, while the remaining weaving frames, in FIG. 1 the weaving frames 6A and 6D, are held in the uppermost position. The weaving frames 6A–6C are in this manner moved down and up one after the other.

As shown in FIG. 1, it is known to place the back rest 4, or at least the vertex 14 at the start of the weaving shed 9, higher than the normal weaving plane 15, the weaving plane 15 being essentially understood to be the plane which coincides with the bisector of the angle which is formed on the cloth line 10 by the extreme directions of the warp threads. Because of this, the tension in the top warp threads at the moment that the weft threads are beaten up is less than the tension in the bottom warp threads. Vertex 14 forms a first fixed position and the cloth line 10 forms a second fixed position between which the weaving frames guide the warp threads over different courses. This is clarified in FIG. 1, in which the position is shown at the moment that a weft thread is beaten up. The weaving frame 6B moving upward and the weaving frame 6C moving downward are hereby as is known in an intermediate position, wherein the thread eyes 5B and 5C are situated at equal distances from the weaving plane 15. At the height of the cloth line 10 the fabric 1 is supported by a fabric support 16, through which the plane of the fabric 1 need not necessarily coincide with the weaving plane 15.

Figure 2:
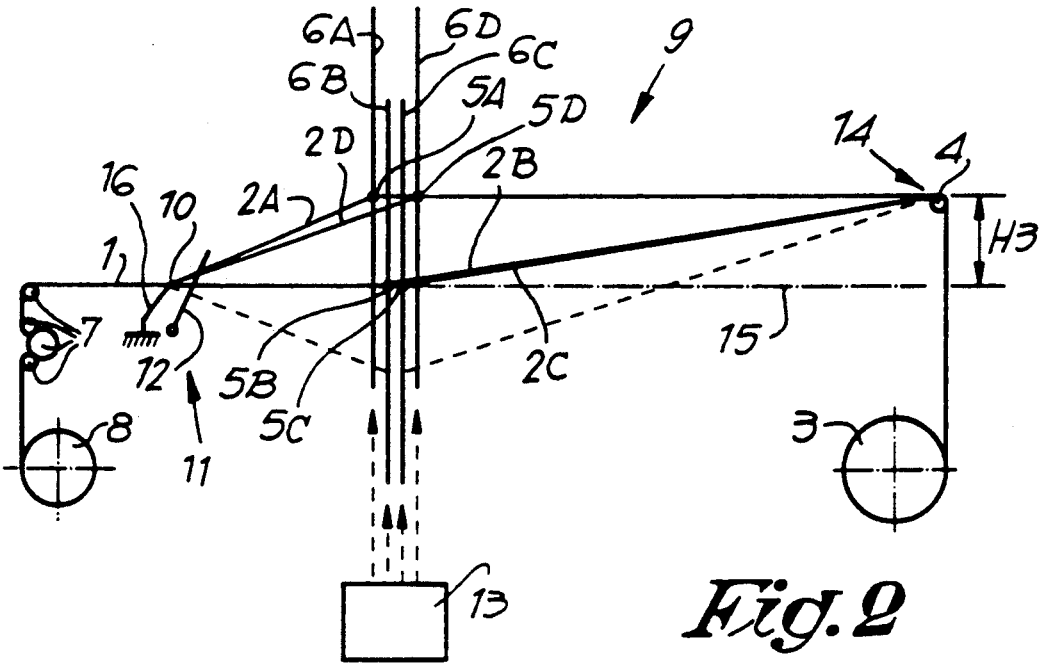
FIG. 2 is a schematic view of the weaving process of FIG. 1 at the moment that the moving weaving frames cross each other.

With a machine stoppage it is usual that the weaving frames crossing at that moment, for example 6B and 6C, are brought to the same height. A position as shown in FIG. 2 consequently develops. The course followed by the top warp threads 2A and 2D is greater than the course followed by the bottom or crossing warp threads 2B and 2C, with the result that a difference in stretch occurs, through which the relaxation, or in other words the lengthening of the warp threads 2A and 2D, on the one hand, and 2B and 2C, on the other hand, is different under the influence of a long-term constant tension. As a result of this difference when the weaving process is resumed, starting stripes can occur in the fabric.

Figure 3:
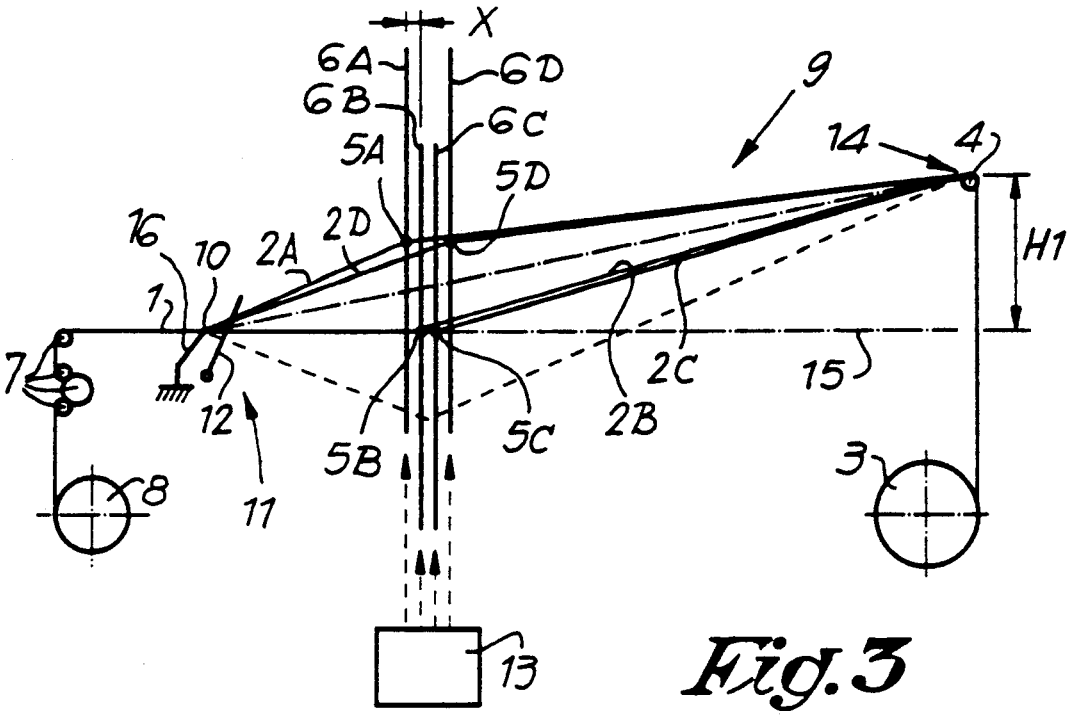
FIG. 3 is a schematic view of a weaving process according to a preferred embodiment of the invention.

According to a first embodiment of the invention, this problem is remedied by applying the method shown in FIG. 3, which utilizes a weaving shed 9 formed for this purpose and wherein at the moment of crossing, the length of the course or path followed by the bottom warp threads at that moment is equal or almost equal to the length of the course or path followed by the top warp threads.

In the specific case shown in FIG. 3 this signifies that the length of the course followed by the warp threads 2B and 2C is equal to the length of the course followed by the warp threads 2A and 2D.

It will be noticed that the length of the course which is followed by the warp thread 2A differs slightly from the length of the course followed by the warp thread 2D, because the thread eyes 5A and 5D are in different locations. The same can be said for the warp threads 2B and 2C and the accompanying thread eyes 5B and 5C. Because the mutual distance X between the successive weaving frames 6A–6D in reality is very little, and small in relation to the dimensions of the weaving shed 9, these differences will not be discussed in further depth hereafter and in practice, the approach schematically illustrated in FIG. 4 can be taken, whereby it is assumed that all four thread eyes 5A–5D are located on the same vertical line.

Figure 4:
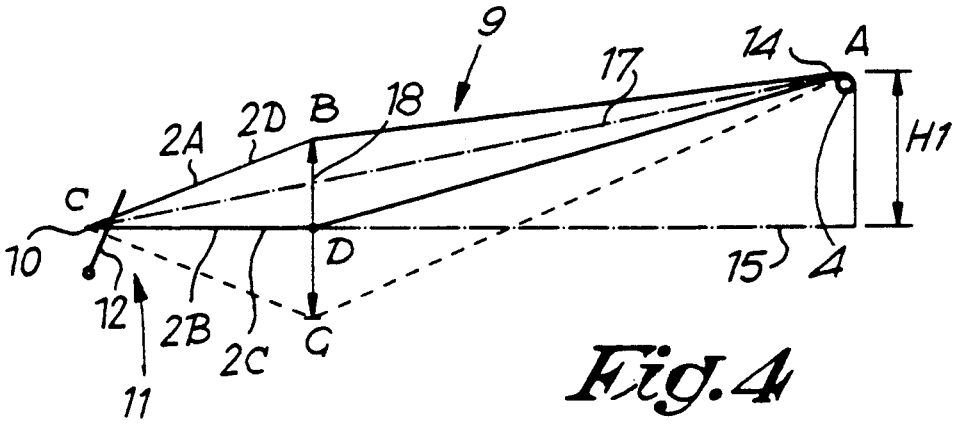
FIG. 4 shows schematically the weaving shed of FIG. 3.

As a result of the above the length of the course ABC in FIG. 4 is equal to or almost equal to the length of the course ADC. According to FIGS. 3 and 4 this is achieved by localizing the aforementioned vertex 14 in such a place that both lengths become equal to each other, for example by mounting the back rest 4 in a well-defined position.

In other words the connecting line 17 between the aforementioned vertex 14 and the cloth line 10 should cut the line section BD at a point 18 which almost coincides with the middle of the line section BD.

Figure 5:
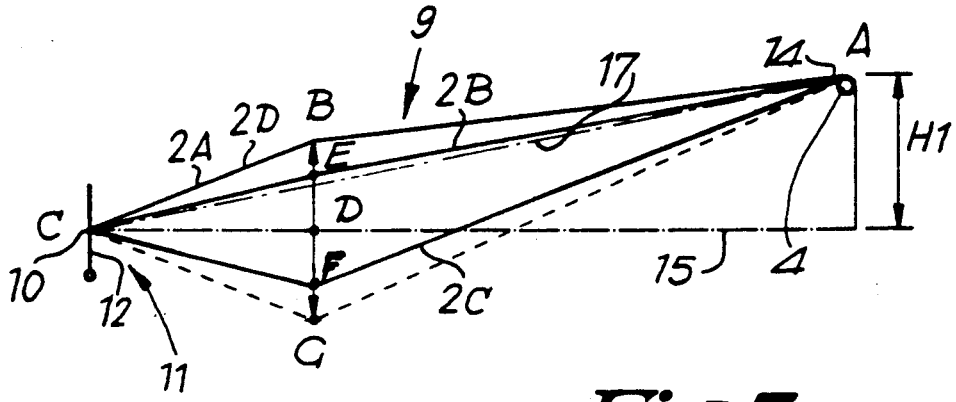
FIG. 5 shows schematically the weaving shed FIG. 4 at the moment of the beating up.

At the moment that the reed 11 strikes, the warp threads 2B and 2C are in positions as shown in FIG. 5. This FIG. 5 shows that the length of the course AEC is less then the length of the course AFC, in other words that the warp threads 2B moving upward follow a shorter course than the warp threads 2C moving downward, through which as mentioned above a more beautiful fabric can be obtained.

FIGS. 3 to 5 show that the vertex 14 needs to be moved over a relatively large distance H1. In practice this is difficult to achieve on most weaving machines, because these machines do not generally allow the back rest to be moved over the distance H1 and because such a highly placed back rest 4 is inconvenient for providing the weaver access to the warp. Furthermore, in the lowest position of the weaving frames, the course AGC to be followed by the warp threads is considerably longer that the aforementioned course ABC, which can lead to inadmissible tensions developing in the warp threads when their respective frames are brought into the lowest extreme position, so that thread breakages arise.

In order to remedy these disadvantages still further provisions will be made in the most preferred embodiment of the invention, as explained hereafter on the basis of FIGS. 6 to 8.

Figure 6:
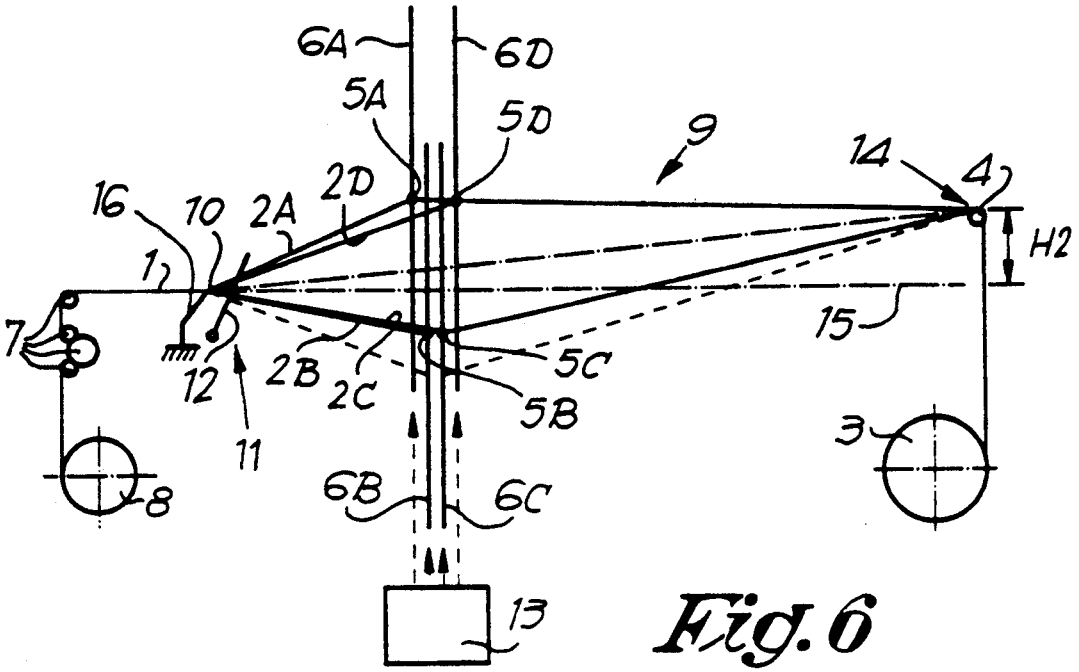
FIG. 6 shows schematically a weaving process according to a second preferred embodiment of the invention.
Figure 7:
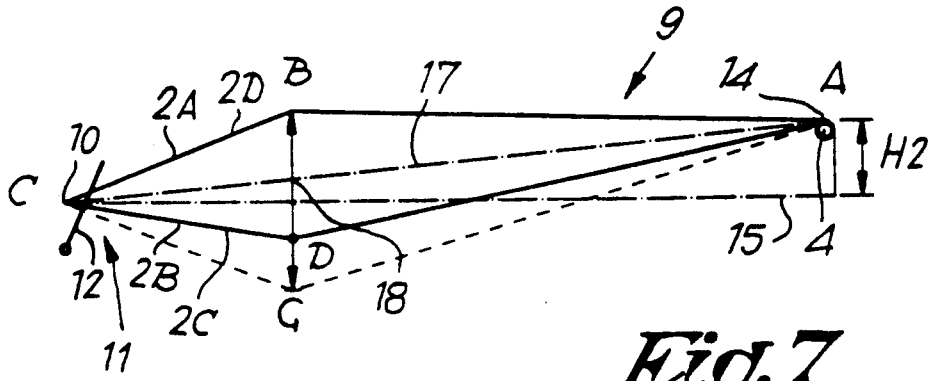
FIG. 7 shows schematically the weaving shed from FIG. 6.
Figure 8:
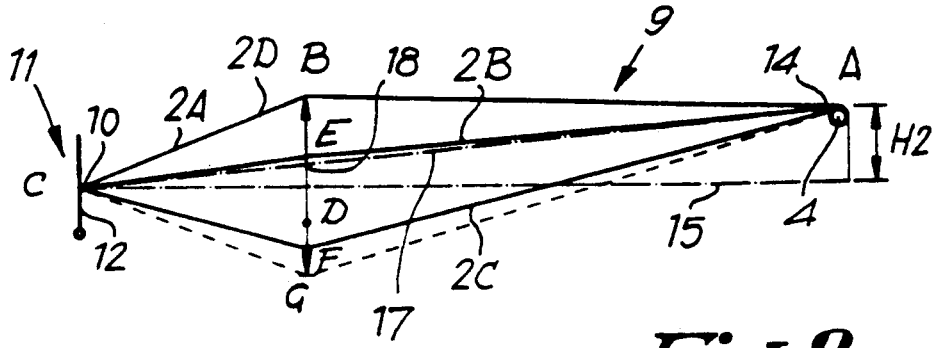
FIG. 8 shows schematically the weaving shed of FIG. 7 at the moment of the beating up.

The particular additional characteristic of the method which is represented in FIGS. 6 to 8 is that the weaving frames are driven asymmetrically, such that the place D where the moving warp threads cross each other no longer coincides with the weaving plane 15, but is moved in relation to this plane in a direction on the opposite side of the weaving plane 15 such that the aforementioned place D is located in relation to the thread eyes of the weaving frames held in their extreme position. More concretely, this means that in the example of FIGS. 6 and 7, the thread eyes 5B and 5C are located below the weaving plane 15 at the moment that the weaving frames 6B and 6C cross each other. In this manner, the courses ABC and ADC show an equal length, while the vertex 14 needs only to be moved over a small height H2 in comparison to the aforementioned height H1.

It can by analogy be stated of this embodiment that the aforementioned connecting line 17 needs to cut the line section BD at a point 18 which almost coincides with the middle of the line section BD.

As shown in FIG. 8, during the beating up the advantages of the difference between the lengths of the warp threads, in this case 2B and 2C, are also retained.

As shown in FIGS. 6 to 8 by moving the place where the weaving frames cross each other in relation to the weaving plane 15, the height H2 over which the vertex 14 needs to be moved, may be smaller than the height H3 in the known arrangement of FIG. 1, and yet a better effect is obtained than in FIG. 1.

It is noted that at the moment of the beating up, as shown in FIG. 8, the warp threads 2C are practically in their extreme position, so that the warp tension necessary for the beating up is approximately equal to the maximum warp tension. This offers the advantage that the average tension in the warp can be selected higher without increasing the number of warp thread breakages which will occur, which raises the fabric quality.

The placing of the back rest 4 at a small height H3 has at the same time the advantage that with closely beaten up weft threads, as is the case with blue jeans, for example stripes in the fabric with the restarting of the machine can be avoided.

The invention likewise relates to a device for implementing the aforementioned method, in particular the method which is applied in FIGS. 6 to 8.

Figure 9:
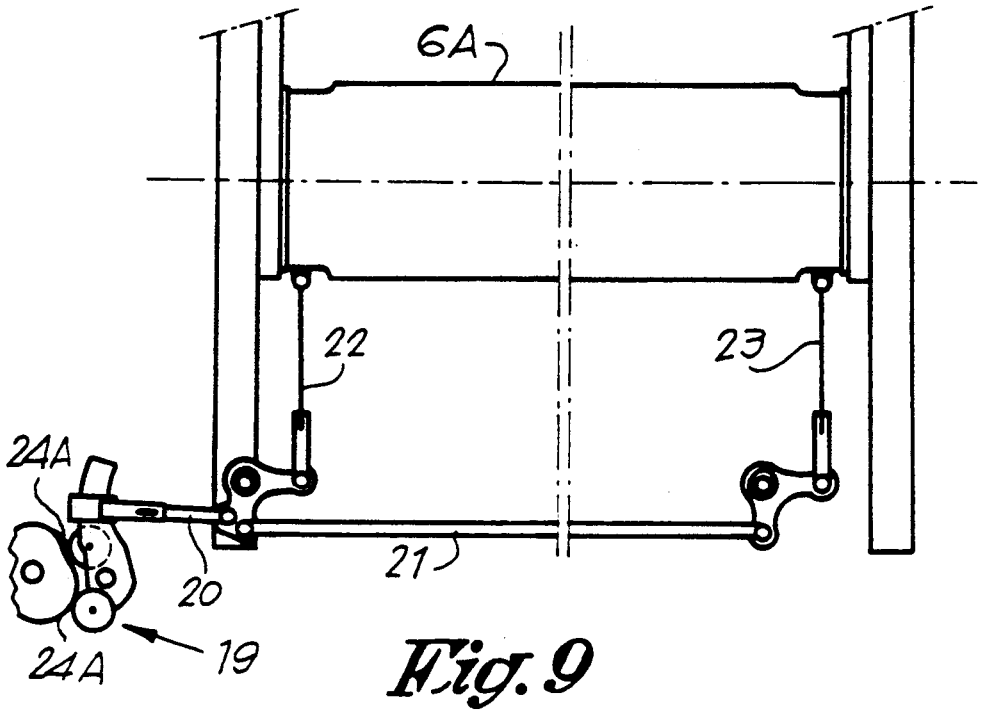
FIG. 9 is a plan view of a preferred device for carrying out the preferred methods.
Figure 10:
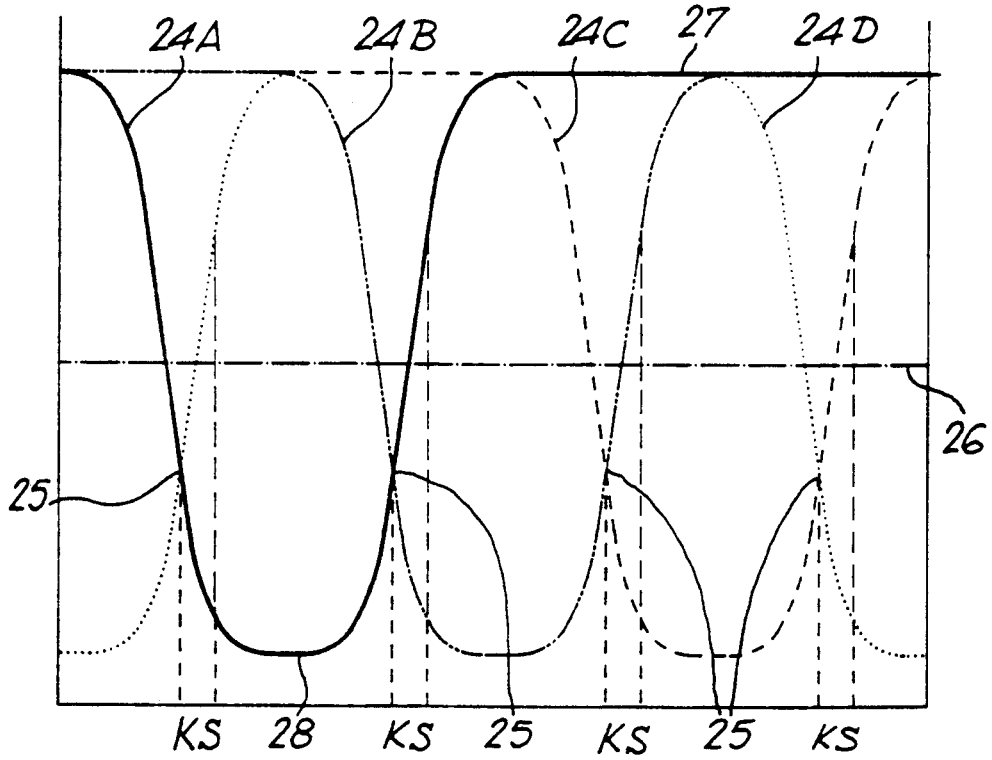
FIG. 10 is a graph illustrating the course of the cams which in the device according to FIG. 9 can be applied in order to realize the invention.

As shown in FIG. 9 use is preferably made of a cam drive 19 which provides the movement of the weaving frames 6A–6D via the necessary levers 20–23. The cam drive 19 is asymmetric, so that the cams 24A–24D follow a course as shown in FIG. 10, in which the curves of the cams cross each other at places 25 which are located asymmetrically, in other words which do not coincide with the line 26 which indicates the middle between the highest part 27 and the lowest part 28 of each cam. It is clear that these places 25 and the parts 27 are opposite each other in relation to the line 26. The crossing of two weaving frames occurs at the moment K, while the beating up of a weft thread occurs at the moments S.

It is clear that according to the invention the tensions in the upper and lower warp threads, at least at the moment that the weaving frames cross each other, are preferably precisely equal to each other. However, an approximation of this situation is also covered by the invention.

The present invention is in no way restricted to the embodiments described above and shown in the drawings, but such method for weaving, as well as the device which can be applied for this purpose, can be developed according to different variants without departing from the scope of the present invention.

We claim:

1. A method for weaving in which use is made of a set of weaving frames arranged to guide a plurality of warp threads over different courses from one fixed position to another fixed position, and which includes the steps of, during a plurality of weaving cycles, holding at least one of the weaving frames in said set in a same extreme position in each of said weaving cycles, while moving all remaining weaving frames such that a bottom warp thread and a top warp thread at the moment of beating up have different tensions, and further comprising the step of causing a weaving shed to be formed in which, at a moment of crossing of the weaving frames and warp threads, a length of courses followed by the crossing warp threads is substantially equal to a length of courses followed by the warp threads held in said same extreme position.

2. A method as claimed in claim 1, wherein the step of moving all remaining weaving frames includes the step of moving the weaving frames assymetrically such that crossing occurs at a place outside a weaving plane.

3. A method as claimed in claim 2, wherein said place outside the weaving plane is on a first side of the weaving plane, and wherein the extreme position where the non-moving weaving frames are held is on a second side of the weaving plane.

4. A method as claimed in claim 1, wherein a connecting line between a vertex at the start of the weaving shed and a cloth line is so located that the connecting line intersects a line section between the crossing position of the warp threads and the position of the warp threads held in extreme position at a point which substantially coincides with a middle of said line section.

5. A device which includes a plurality of weaving frames supporting top and bottom warp threads and means for causing the weaving frames to move during a plurality of weaving cycles, in which at least one of the weaving frames is held in a same extreme position, while all remaining weaving frames are moved, and for thereby causing different tensions to be provided for the top and bottom warp threads at a moment of beating up, wherein said means for causing the weaving frames to move includes a cam drive and levers, and wherein said cam drive has means to hold the weaving frames in the extreme position and to cause the weaving frames to cross each other at places which are located outside a weaving plane, and wherein the places of crossing on the one hand and the extreme position where the weaving frames are held, on the other hand, are respectively located on opposite sides of the weaving plane.

* * * * *